United States Patent [19]

Imaizumi et al.

[11] Patent Number: 5,008,715

[45] Date of Patent: Apr. 16, 1991

[54] COPYING MACHINE ALLOWING MANUAL FEED OF COPYING PAPER

[75] Inventors: Masaru Imaizumi; Yoshiaki Takano, both of Osaka, Japan

[73] Assignee: Minolta Camera Kabushiki Kaisha, Osaka, Japan

[21] Appl. No.: 205,186

[22] Filed: Jun. 10, 1988

[30] Foreign Application Priority Data

| | | | |
|---|---|---|---|
| Jun. 11, 1987 | [JP] | Japan | 62-145901 |
| Jul. 20, 1987 | [JP] | Japan | 62-181712 |
| Jul. 20, 1987 | [JP] | Japan | 62-181713 |
| Jul. 20, 1987 | [JP] | Japan | 62-181714 |

[51] Int. Cl.[5] ..... G03G 21/00

[52] U.S. Cl. ..... 355/313; 355/309

[58] Field of Search ..... 355/206, 208, 313, 314, 355/308, 309

[56] References Cited

U.S. PATENT DOCUMENTS

| | | | |
|---|---|---|---|
| 4,204,668 | 5/1980 | Yanagawa | 355/314 X |
| 4,349,269 | 9/1982 | Okada | 355/208 X |
| 4,383,756 | 5/1983 | Hanamoto et al. | 355/314 |
| 4,392,740 | 7/1983 | Ito et al. | 355/313 |
| 4,394,088 | 7/1983 | Hanamoto et al. | 355/208 |
| 4,417,350 | 11/1983 | Ito et al. | 355/313 X |
| 4,611,904 | 9/1986 | Wada | 355/313 |
| 4,685,797 | 8/1987 | Ito | 355/313 |
| 4,791,457 | 12/1988 | Shida | 355/309 |

FOREIGN PATENT DOCUMENTS 61-171746 10/1986 Japan .

*Primary Examiner*—Fred L. Braun

*Attorney, Agent, or Firm*—Burns, Doane, Swecker & Mathis

[57] ABSTRACT

A copying machine operable in a manual copying paper feed mode and an automatic copying paper feed mode which has an automatic paper feeding section and an inlet for receiving copying paper inserted manually. The automatic paper feeding section includes a cassette containing copying paper to be fed automatically, a feed roller for feeding the copying paper, and a lifting mechanism for lifting the copying paper for pressure contact with the feed roller. The inlet has a cover which is opened for manually inserting copying paper, and a guide member for guiding the copying paper to a position between the feed roller and the copying paper contained in the cassette. The manual feed mode is automatically switched to the automatic feed mode when the manually fed copying paper is exhausted and the cover remains closed for a predetermined time during the manual feed mode.

16 Claims, 15 Drawing Sheets

COPYING MACHINE ALLOWING MANUAL FEED OF COPYING PAPER

BACKGROUND OF THE INVENTION (1) Field of the Invention

The present invention relates to copying machines having a manual paper feeding function and an automatic paper feeding function.

(2) Description of the Related Art

Various copying machines having a manual paper feeding function have been proposed in recent years for allowing duplex copying and composite copying with conventional simple construction without relying on sophisticated copying machines. The proposed copying machines employ either a type of manual paper feeding device with a feed roller of its own or a type with a feeding roller and an automatic paper feeding cassette. A trend has formed in favor of the latter because of the lower cost in spite of the more complicated construction.

A type of manual paper feeding device which shares a feed roller with a cassette is disclosed, for example, in Japanese Utility Model Publication Kokai No. 61-171746. This device is comprised of an openable and closable table attached to a machine body for supporting manually fed copying paper. The table has a forward end thereof in pressure contact with the feed roller from below when the table is opened. The device further comprises a lever shaft rotatable with opening and closing of the table. The lever shaft has a return lever for limiting the leading end of the copying paper, a feed roller lift lever for pushing the feed roller upward, and a manual feed lever for rotating the lever shaft from outside.

When making copies with manually fed copying paper, the sheets of copying paper may be placed one by one on the table when the table is in the open position and insert under the feed roller whereby the sheets are delivered into the copying machine. For making a plurality of copies successively with manually fed copying paper, the table is kept open and the lift lever is operated to retract the feed roller upwardly from the table surface, and a plurality of copying sheets are manually placed on the table and inserted until the leading ends of the sheets contact the return lever. Thereafter the manual feed lever is lowered to bring the feed roller into pressure contact with the copying sheets. As a result all of the copying sheets manually placed on the table are ready for successive delivery into the copying machine.

This manual paper feeding device, however, involves different operations when manually feeding a single sheet of copying paper than when feeding a plurality of copying sheets. The operation is troublesome particularly when feeding a plurality of copying sheets in because the manual feed lever must be operated. The manual feed lever acts also to press the copying sheets.

Moreover, with the known device, the number of copying sheets for manual feeding is limited by the gap between the feed roller and the table. There is also the problem of poor operability because the table must be returned to the original position after the copying paper is fed manually.

SUMMARY OF THE INVENTION

The object of the present invention is to provide an improved copying machine which facilitates manual feeding of copying paper and allows a plurality of copying sheets to be manually set in position at the same time.

The above object is fulfilled, according to the present invention, by a copying machine which comprises an automatic paper feeding section including a support means for supporting the copying paper to be fed automatically, a feed means for feeding the copying paper, and a switch means for selectively providing a state in which the copying paper is pressed between the support means and the feed means and a state in which the copying paper is released from a pressing force; an inlet for receiving copying paper inserted manually and allowing the manually inserted copying paper to advance to a position between the support means and the feed means and to be pressed therebetween by action of the switch means; and a control means for controlling a feeding process and a copying process of the copying paper.

In the above embodiment, the manually inserted copying paper is set between the feed means and the support means of the automatic paper feeding section, more particularly between the feed means and the copying paper resting on the support means, and pressed by the switch means. In other words, the pressure is applied to the manually inserted copying paper by the same means that applies pressure to the copying paper for automatic feeding. Consequently, this embodiment produces a satisfactory pressing effect and provides the advantage of simplifying the construction of the manual paper feeding device. Further, the number of sheets of the manually fed copying paper is not limited by the gap between the feed roller and the manual feed paper table as in the prior art. Although the number of sheets capable of being feed manually depends upon the number of sheets placed on the support means before hand, the number of sheets that may be fed manually is greater than the number of sheets disclosed in the prior art.

In a preferred embodiment of the invention, the switch means is operable to press the automatically fed copying paper between the support means and the feed means when the cover of the inlet is closed and to release the copying paper from the pressing force when the cover is opened. This embodiment eliminates the problem in the prior art of having to return the paper support table to the original position after manual paper feeding.

In another preferred embodiment, the control means is operable to control the copying machine in a manual paper feed mode where the copying paper is fed through the inlet and in an automatic paper feed mode where the copying paper is fed from the automatic paper feeding section. The manual paper feed mode is automatically switched to the automatic paper feed mode when the cover remains closed for a predetermined period after the copying paper fed through the inlet is exhausted.

In the copying machine according to this embodiment, a switch is automatically made to the automatic paper feed mode upon lapse of a predetermined period after a copying operation with the manually fed copying paper is completed. Consequently, even when the user forgets to open the cover of the manually fed paper inlet, the next user needs only to press the print switch to start making copies with the automatically fed copying paper.

In a further preferred embodiment of the invention, the copying machine has a paper feed mode selecting means for switching between the manual paper feed mode and the automatic paper feed mode. The control means allows the paper feed mode selecting means to switch from the manual paper feed mode to the automatic paper feed mode when the copying paper fed through the inlet is exhausted and the cover means is closed.

This embodiment prohibits a switch to the automatic paper feed mode when the cover is opened or the manually fed copying paper remains in position during the manual paper feed mode. Thus the user will realize that the cover is open or the manually fed paper remains in position when the paper feed mode does not change when using the paper feed mode selecting means. The user must close the cover or remove the manually fed copying paper before making a copy. This arrangement is effective to avoid wasteful miscopying.

In a further preferred embodiment of the invention, the copying machine has an additional automatic paper feeding section dissociated from the manual feed guide. The control means allows the paper feed mode selecting means to switch from the manual paper feed mode to an automatic paper feed mode where the additional automatic paper feeding section is used even when the copying paper fed through the inlet remains in position. This copying machine is capable of making copies by using the additional automatic paper feeding section at any time regardless of the state of the manual paper feeding section.

In a still further preferred embodiment, the control means operates to allow a copying operation with the manually inserted copying paper only when the cover is closed and to interrupt the copying operation when the cover is opened during the manual paper feed mode.

According to this copying machine, a copying operation in the manual paper feed mode is interrupted when the cover is opened. This arrangement allows for the copying operation to be interrupted when more copying sheets than necessary are manually sent through the inlet, by opening the cover after a desired number of copies are made. The copying operation may be resumed in the manual feed mode after the original documents. It is thus unnecessary to decide the number of copying sheets when making copies of every original document. This feature contributes toward improved operability and renders the copying machine convenient to use.

The foregoing and other objects, features and advantages of the invention will become more apparent from the following detailed description of the preferred embodiments of the invention, as illustrated in the accompanying drawings.

DETAILED DESCRIPTION OF THE PREFERRED EMBODIMENTS

The present invention will be described further with reference to the accompanying drawings which illustrate an embodiment of the invention. Various components and operations of the embodiment will be described in the following order:

A. Constructional Outline and Operation of Copying Machine

Figure 1:
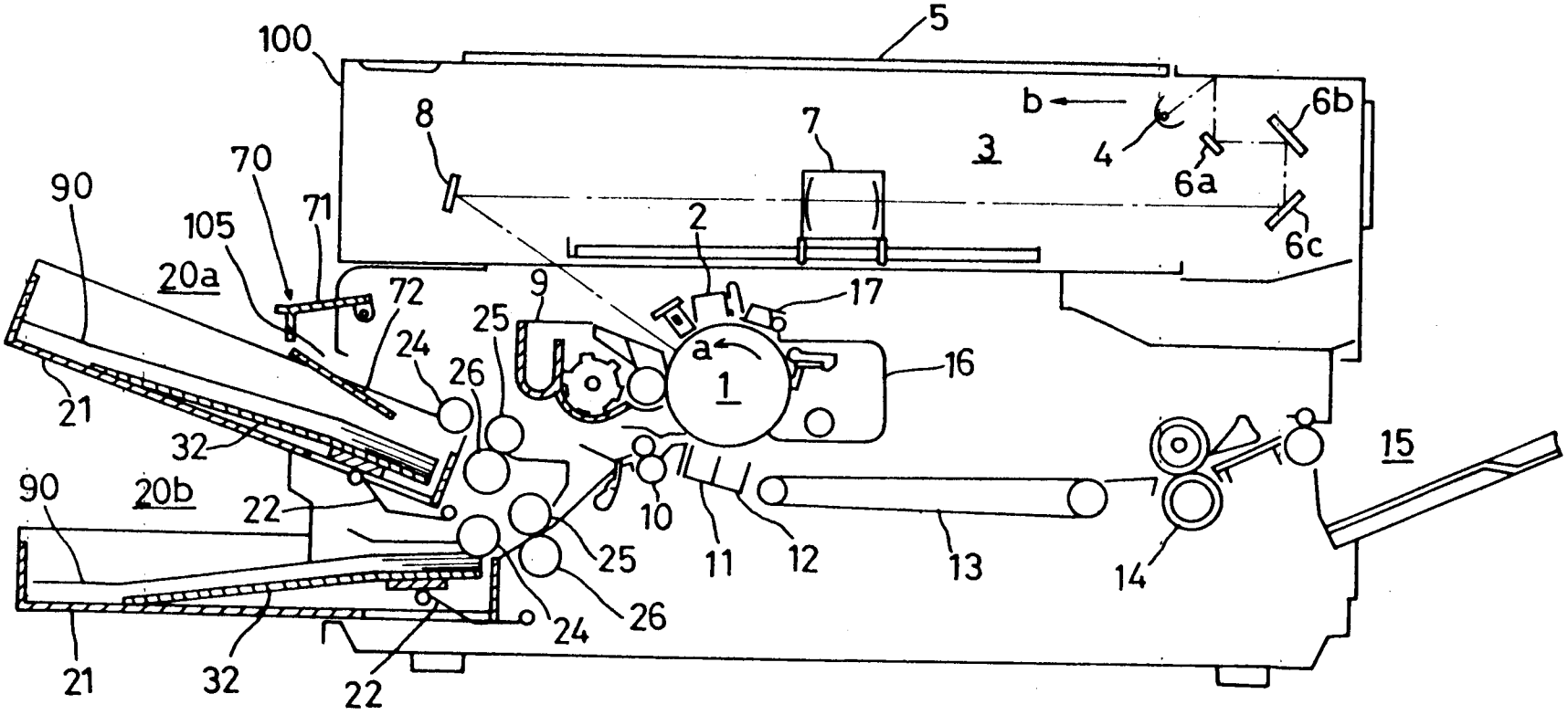
FIG. 1 is a sectional view of a copying machine having a manual paper feeding device according to the present invention.

B. Construction of Paper Feeding Mechanism (a) Cassettes (b) Lift Levers (c) Lifting Mechanism (d) Paper Feed Roller (e) Forward Rotation Rollers and Backward Rotation Roller (f) Return Lever (g) Copying Paper Detecting Switch (h) Manual Paper Feeding Device (i) Manual Feed Guide (j) Manually Fed Paper Detecting Switch C. Cassette Paper Feeding Operation D. Manual Paper Feeding Operation E. Control Panel F. Control Circuit G. Control Operations (a) Main Routine (b) Manual Paper Feed Accepting Subroutine (c) Paper Feed Mode Selecting Subroutine (d) Automatic Paper Feed Mode Switching Subroutine (e) Paper Empty Detecting Subroutine A. Constructional Outline and Operation of Copying Machine FIG. 1 shows a copying machine having a manual paper feeding device according to the present invention. A constructional outline and copying operation of this copying machine will be described first.

The copying machine is comprised of a photoreceptor drum 1 rotatable in the direction of arrow a, and a charger 2 for charging the surface of photoreceptor drum 1 in rotation through a discharge of electricity.

The copying machine also has an optical system 3 including a scanner with an exposure lamp 4 and mirrors 6*a*, 6*b* and 6*c*. The scanner 4 is movable in the direction of arrow b to illuminate and scan an original document placed on a document supporting glass plate 5. The light reflected by the document travels by way of the mirrors 6*a*, 6*b* and 6*c*, a lens 7 and a mirror 8 to the photoreceptor drum 1, whereby an electrostatic latent image corresponding to the original image is formed on the surface of drum 1. Toner is then applied to the latent image by developer 9, whereby the original image is reproduced in the form of a toner image.

Copying paper 90 is fed from a paper feeding section 20*a* with a manual feeding device 70, or from a paper feeding section 20*b*, which will be described later. A timing roller pair 10 advances the copying paper to a position opposite to a transfer charger 11 in timed relationship with the toner image on the photoreceptor drum 1. At the transfer charger 11, the toner image is transferred from the drum 1 to the copying paper. The copying paper is then separated from the drum 1 by a separating charger 12, and is thereafter transported by a conveyor belt 13 to a fixing roller pair 14 for fixing the toner image to the copying paper by thermal fusion. Then, the copying paper is discharged to a paper discharge section 15.

The toner remaining on the surface of photoreceptor drum 1 is scraped off by a cleaning device 16. Thereafter, the electric charge remaining on the surface of drum 1 is erased through illumination by an eraser lamp 17 in order to prepare for a next copying cycle.

B. Construction of a Paper Feeding Mechanism

A paper feeding mechanism comprised of the paper feeding sections 20*a* and 20*b* and the manual feeding device 70 will be described next.

Figure 2:
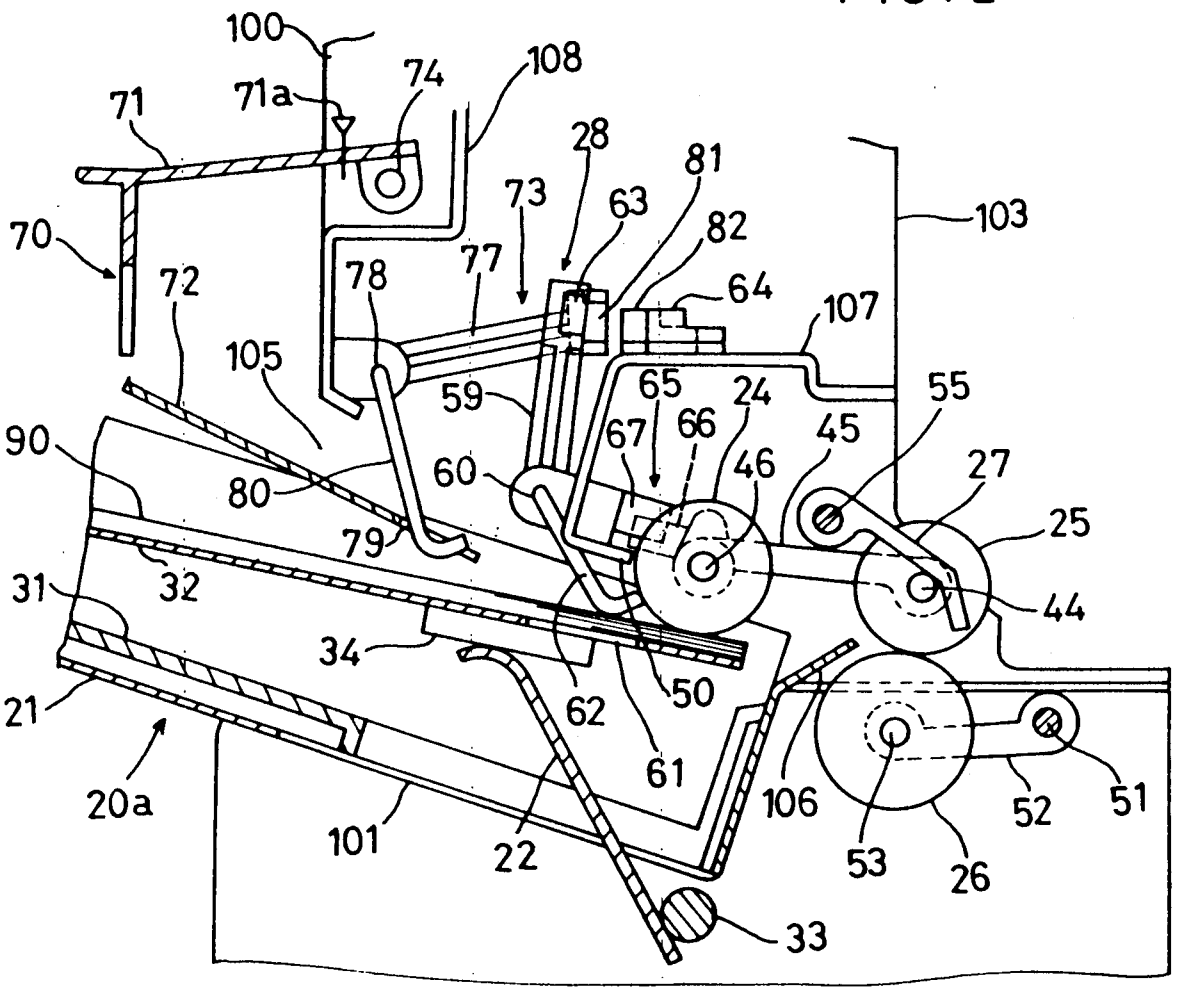
FIG. 2 is an enlarged sectional view of a paper feeding section of the copying machine shown in FIG. 1.
Figure 3:
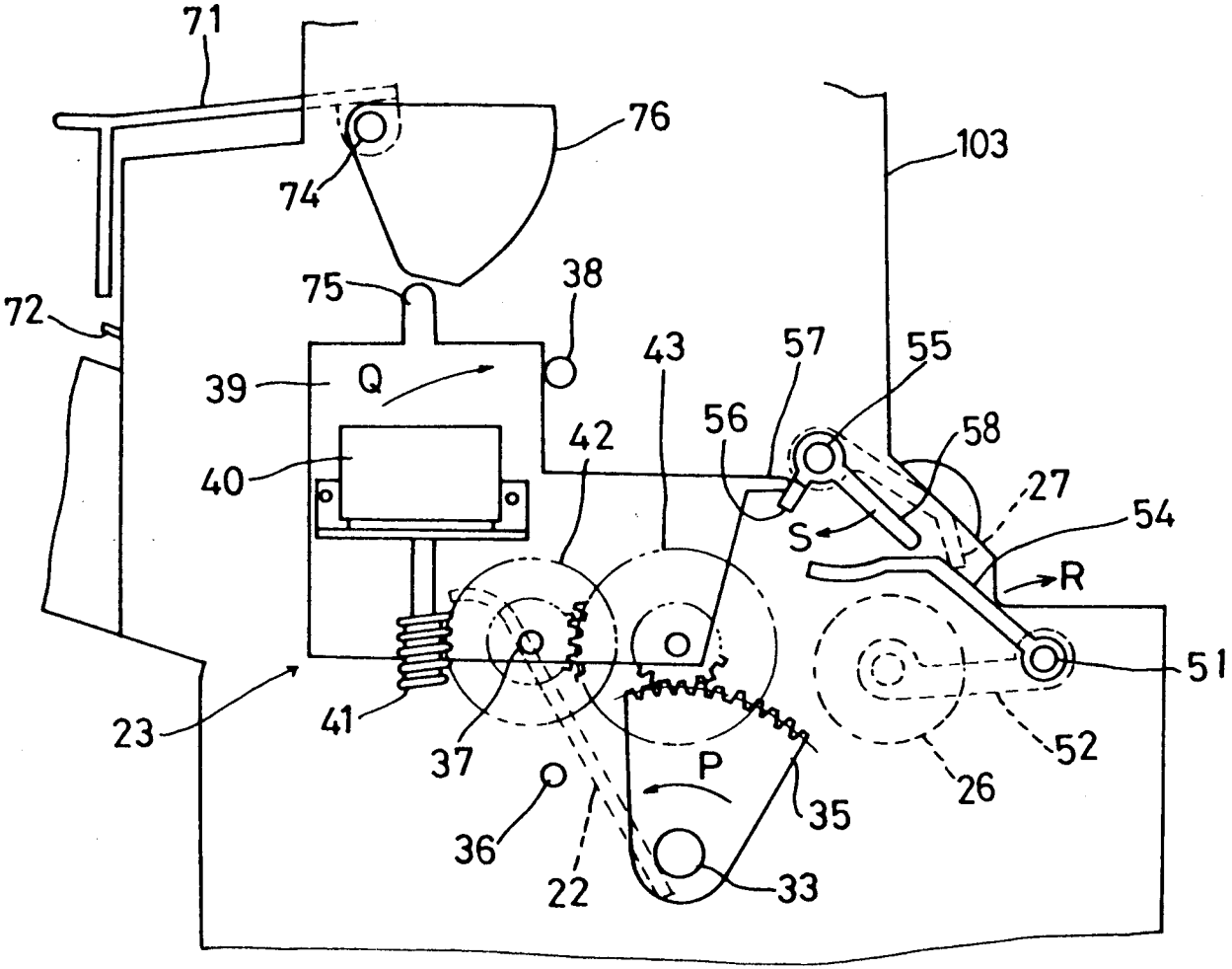
FIG. 3 is a front view of the paper feeding section as seen from outside a machine frame.
Figure 4:
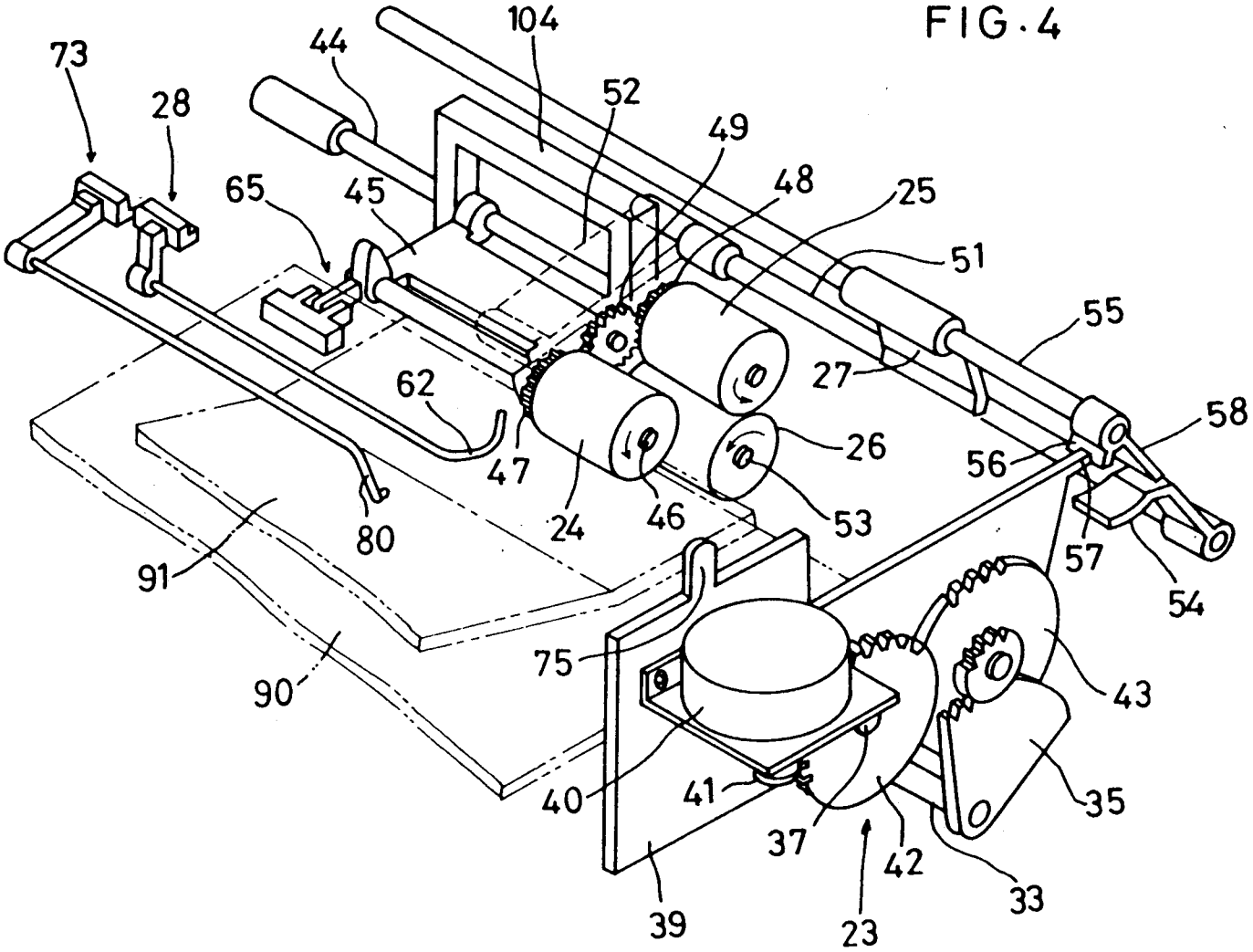
FIG. 4 is a perspective view of the paper feeding section.

Each of the paper feeding sections 20*a* and 20*b* includes a cassette 21, a lift lever 22, a lifting mechanism 23 (FIG. 3), a paper feed roller 24, a forward rotation roller 25, a backward rotation roller 26, a return lever 27 (FIGS. 2 through 4) and a copying paper detecting switch 28 (FIGS. 2 and 4).

(a) Cassette 21

The cassettes 21 are removably mounted in cassette receiving sockets 101 arranged one over the other in a side face of a copying machine body 100 as shown in FIG. 2 (which shows only the upper cassette). Each cassette 21 includes a tray 31 with the rear end of a lifting plate 32 engaging an unillustrated groove located in the bottom of the tray 31.

(b) Lift Lever 22

The lift lever 22 is rigidly connected at one end thereof to a lift shaft 33 supported by the frame 103 of the machine body 100. The other end of the lift lever 22 is contactable with a projection 34 located on the undersurface of lifting plate 32. As shown in FIG. 3, the lift shaft 33 carries a segment gear 35 fixed to one end thereof. The segment gear 35 is urged in the direction of arrow P by an unillustrated spring for engagement with a stopper 36, which releases the lift lever 22 from the cassette 21. Further, the segment gear 35 is rotatable in the opposite direction by the lifting mechanism 23 described hereunder, to cause the lift lever 22 to push the lifting plate 32 upward.

(c) Lifting Mechanism 23

As shown in FIGS. 3 and 4, the lifting mechanism 23 includes a mounting plate 39 supported by the frame 103 of machine body 100 so that it is rotatable around a support shaft 37 and urged in the direction of arrow Q for engagement with a stopper 38, a motor 40 fixed to the mounting plate 39, a first reduction gear 42 mounted coaxially with the support shaft 37 and meshed with a worm 41 attached to the transmission shaft of the motor 40, and a second reduction gear 43 attached to the mounting plate 39 and meshed with the first reduction gear 42 and the segment gear 35.

(d) Paper Feed Roller 24

As shown in FIG. 4, the paper feed roller 24 is supported through a feed roller shaft 46 by a roller holder 45 pivotably attached to a drive shaft 44 which is rotatably supported by the frame 103 through a mounting frame 104. This paper feed roller 24 is urged by an unillustrated spring to contact the copying paper 90 contained in the cassette 21. The feed roller shaft 46 carries a feed roller gear 47 which is meshed through an intermediate gear 49 with a drive gear 48 mounted on the drive shaft 44. Thus, the paper feed roller 24 is rotated by an unillustrated motor connected to the drive shaft 44, to feed the copying paper 90 to a position between the forward rotation roller 25 and the backward rotation roller 26.

When the copying paper 90 contained in the cassette 21 is not pushed upward by the lift lever 22, the paper feed roller 24 is urged downward. In this position, a lift detecting lever 66 attached to the distal end of roller holder 45, which will be described later, engages an end stopper 50 of a mounting plate 107 attached to the frame 103 of machine body 100.

(e) Forward Rotation Roller 25 and Backward Rotation Roller 26.

As shown in FIG. 4, the forward rotation roller 25 is mounted on one end of the drive shaft 44.

The backward rotation roller 26, as shown in FIGS. 2 and 4, is supported through a roller shaft 53 by a roller holder 52 fixed to a paper control shaft 51 supported by the frame 103 of machine body 100. This backward rotation roller 26 is urged in the direction of arrow R as shown in FIG. 3, by an unillustrated spring, for pressure contact with the forward rotation roller 25. The roller shaft 53 carries a gear, not shown, meshed with the intermediate gear 49, whereby the backward rotation roller 26 is rotation gear 25. The paper control lever 51 carries a passive lever 54 fixed to one end thereof, which is pressed by a control lever 53 of the return lever shaft 55 to be described later. Consequently, the paper control shaft 51 rotates to swing the roller holder 52 in order to move the backward rotation roller 26 into and out of pressure contact with the forward rotation roller 25.

(f) Return Lever 27

As shown in FIGS. 2 through 4, the return lever 27 is fixed to the return lever shaft 55 which is supported by the frame 103 of machine body 100. The return lever 27 is urged in the direction of arrow S in FIG. 3 by an unillustrated spring. The return lever shaft 55 has a claw 56 at one end thereof to engage the projection 57 located on the mounting plate 39. Thus, the return lever 27 is situated above and forward of the leading end of the copying paper 90 contained in the cassette 21, and above of the position of pressure contact between the forward rotation roller 25 and the backward rotation roller 26. As shown in FIG. 3, the return lever shaft 55 further has the control lever 58 at the same one end thereof. The control lever 58 is opposed to the passive lever 54 on the paper control shaft 51 when the claw 56 engages the projection 57 on the mounting plate 39. The urging force applied to the return lever 27 or the control lever 58 in the direction S is greater than the urging force applied to the backward rotation roller 26 or passive lever 54 in the direction R.

(g) Copying Paper Detecting Switch 28

As shown in FIGS. 2 and 4, the copying paper detecting switch 28 has a detecting lever 62 attached to one end of the support shaft 60 of the lever holder 59 which is pivotably attached to the mounting plate 107, a detecting lever 62 having a distal end movable into and out of a slit 61 located in the lifting plate 32 of the cassette 21, a magnet 63 mounted on a distal end of the lever holder 59, and a lead switch 64 attached to the mounting plate 107 and opposed to the magnet 63. If the copying paper 90 is on the lifting plate 32, the detecting lever 62 does not enter the slit 61 and the magnet 63 is separated from the lead switch 64. If there is no copying paper, the detecting lever 62 pivots clockwise as shown in FIG. 2 and enters the slit 61, whereby the magnet 63 approaches the lead switch 64.

The lifting mechanism 23 is operable by the on/off operation of a lift detecting switch 65. As shown in FIGS. 2 and 4, the lift detecting switch 65 includes a detecting lever 66 mounted on the free end of the paper feed roller holder 45, and a photocoupler 67 attached to the mounting plate 107. Changes in the position of paper feed roller 24 cause the detecting lever 66 to move into and out of the detecting recess of the photocoupler 67, which switches the motor 40 on and off.

(h) Manual Paper Feeding Device 70

The manual paper feeding device 70 is comprised of a manual feed opening cover 71, a cover detecting switch 71*a*, a manual feed guide 72, and a manually fed paper detecting switch 73, in addition to the tray 31 of the cassette 21, the lift lever 22, the lifting mechanism 23 and the paper feed roller 24 in the paper feeding section 20*a*.

As shown in FIG. 2, the manual feed opening cover 71 is attached to the frame 103 of machine body 100 to pivot about the support shaft 74, and to cover the manual feed opening 105 located above the cassette 21 mounted in the cassette receiving socket 101 opening in the side face of the machine body 100. As shown in FIG. 3, the support shaft 74 carries a cam 76 pivotable with the cover 71 for engagement with a projection 75 defined on the mounting plate 39 of the lifting mechanism 23. When the cover 71 is opened, the cam 76 pushes the projection 75 downward, which causes the mounting plate 39 to pivot on the support shaft 37 in the counterclockwise direction in FIG. 3. Consequently, the second reduction gear 43 becomes disengaged from the segment gear 35, and the projection 57 is separated from the claw 56 of return lever shaft 55.

The cover detecting switch 71*a* is attached to the frame 103 of machine body 100, and is turned on and off by the opening and closing of the cover 71.

(i) Manual Feed Guide 72

The manual feed guide 72 is supported by the frame 103 of machine body 100 at a position over the copying paper 90 contained in the cassette 21 and is pushed upward by the lift lever 22, and extends from the lower end of the manual feed opening cover 71 to the vicinity of the feed roller 24. The guide 72 guides the leading end of copying paper 91 manually fed after opening the cover 71, to a position under the feed roller 24.

(j) Manually Fed Paper Detecting Switch 73

As shown in FIGS. 2 and 4, the manually fed paper detecting switch 73 includes a detecting lever 80 attached to one end of the support shaft 78 of the lever holder 77 which is pivotably attached to a different mounting plate 108, the detecting lever 80 has a distal end which moves into and out of slit 79 defined in the manual feed guide 72, a magnet 81 mounted on a distal end of the lever holder 77, and a lead switch 82 attached to the frame 103 and opposed to the magnet 81. When the copying paper 91 is manually fed, the detecting lever 80 is pushed by the leading end of the copying paper 91 and pivots counterclockwise as shown in FIG. 2. As a result, the magnet 81 separates from the lead switch 82 which detects the manual feeding of copying paper 91.

C. Cassette Paper Feeding Operation

The operation of the copying machine illustrated above will be described first in relation to the paper feeding section 20*a* not using the manual paper feeding device 70.

Referring to FIG. 2, the cassette 21 containing the copying paper 90 is placed in the cassette receiving socket 101 of the machine body 100. Upon lapse of a fixed time after the cassette 21 is placed in position, an unillustrated cassette detecting switch turns on and actuates the motor 40 shown in FIG. 3. Before the motor 40 is actuated, the lift detecting switch 65 remains in the off state since the lifting plate 32 of the cassette 21 is not pushed upward by the lift lever 22 and the feed roller 24 is lowered.

As shown in FIG. 3, the motor 40 drives the segment gear 35 through the first and second reduction gears 42 and 43 which causes the segment gear 35 to swing clockwise against the urging force applied thereto. Consequently, the lift lever 22 pushes the lifting plate 32 upward to press the copying paper 90 against the feed roller 24, and further to push the feed roller 24 upward through the copying paper 90. At this time the lift detecting switch 65 turns on by interception of its light to stop the motor 40 immediately and to make the copying paper 90 ready for feeding. The copying paper detecting switch 28 is turned off since its detecting lever 62 is pushed upward by the copying paper 90.

When, in this state, a print switch is pressed and the drive shaft 44 rotates, the forward rotation roller 25, backward rotation roller 26 and feed roller 24 are rotated. The copying paper 90 is then fed by the feed roller 24 to the position between the forward rotation roller 25 and backward rotation roller 26. The copying paper 90 is advanced further by the timing roller pair 10 to the transfer region between the photoreceptor drum 1 and transfer charger 11 as shown in FIG. 1.

The feed roller 24 lowers with a decrease in the number of sheets of copying paper 90. Then the lift detecting switch 65 is turned off by transmission of its light to actuate the motor 40 immediately. Consequently, the lift lever 22 begins to push the copying paper 90 and feed roller 24 upward until the lift detecting switch 65 is turned on by interception of its light and the motor 40 is stopped. In this way, the copying paper 90 is repeatedly raised by the on/off operation of the lift detecting switch 65 as the sheets of copying paper 90 are consumed, whereby the copying paper 90 contacts the feed roller 24 under a constant pressure all the time. When the copying paper 90 is exhausted, the detecting lever 62 of the copying paper detecting switch 28 enters the slit 61 located in the lifting plate 32 whereby the magnet 63 approaches the lead switch 64. As a result, an indication is given on the control panel that there is no copying paper 90.

D. Manual Paper Feeding Operation

The operation of the paper feeding section 21*a* using the manual paper feeding device 70 will be described next.

Figure 5:
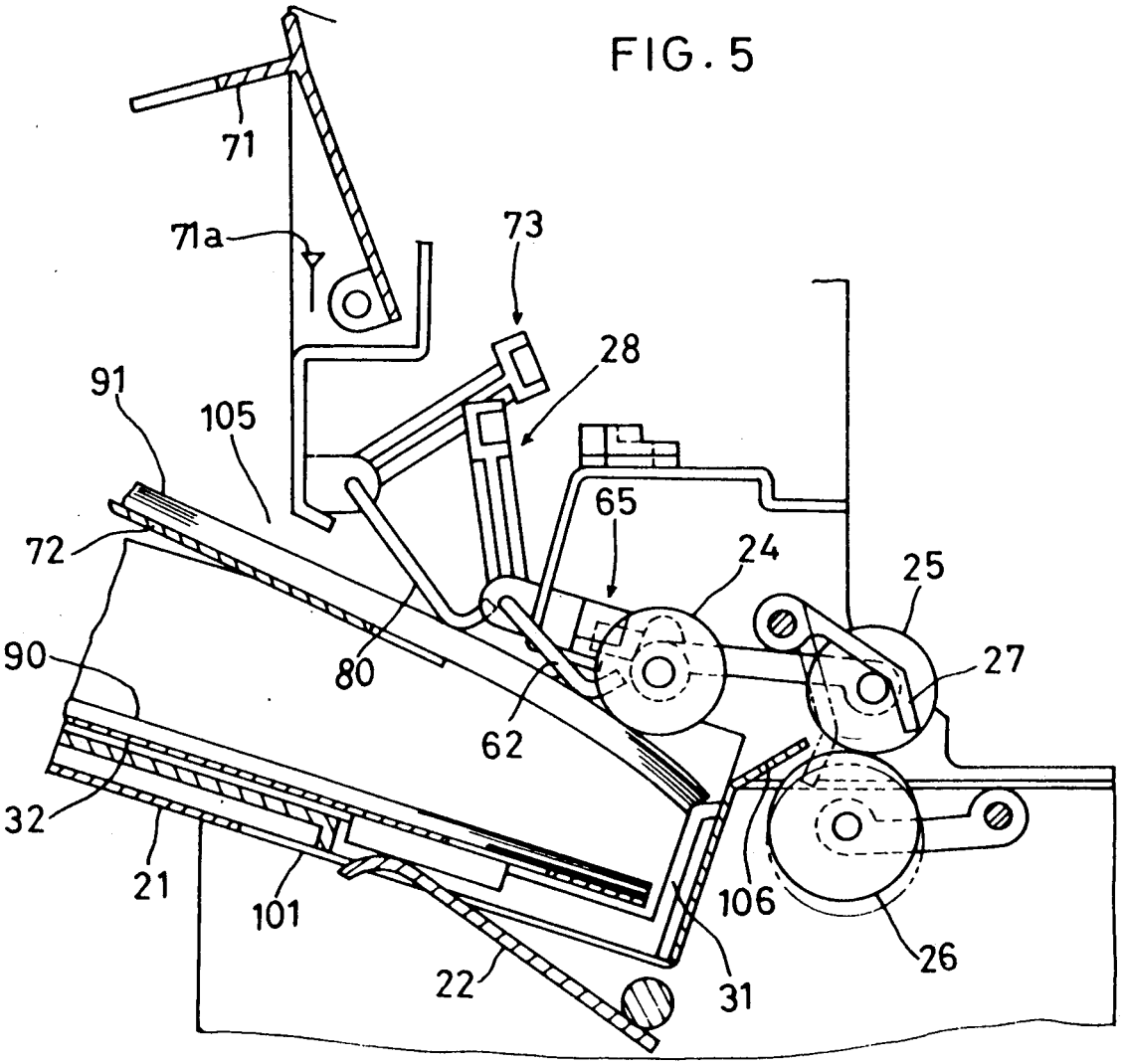
FIG. 5 is a sectional view of the paper feeding section with a cover for a manual feed opening opened.

When the manual feed opening cover 71 is opened as shown in FIG. 5, the cover detecting switch 71*a* is turned off. With the movement of the cover 71, the cam 76 pivots clockwise as shown in FIG. 3 to push the projection 75 downward, whereby the mounting plate 39 pivots counterclockwise about the support shaft 37 against the urging force applied thereto. Then the second reduction gear 43 becomes disengaged from the segment gear 35, and the segment gear 35 pivots counterclockwise with the lift lever 22 under the urging force applied thereto in the direction of arrow P. Consequently, as shown in FIG. 5, the lifting plate 32 lowers because of gravity and the copying paper 90 on the lifting plate 32 is retracted from the feed roller 24 which relieves the feed roller 24 from the pressing force. The feed roller 24 then lowers because of gravity and the lift detecting switch 65 turns off. However, the copying paper detecting switch 28 turns on to keep the lift lever 22 inoperative.

As a result of the pivotal movement of the mounting plate 39 in the counterclockwise direction as shown in FIG. 3, the projection 57 disengages from the claw 56 of return lever shaft 55. The return lever shaft 55 then rotates clockwise under the urging force applied thereto in the direction of arrow S, with the control lever 58 pressing the passive lever 54. Consequently, the paper control shaft 51 rotates counterclockwise against the urging force applied thereto, whereby the backward rotation roller 26 moves away from the forward rotation roller 25 as shown in a two dots and dash line in FIG. 5. With the rotation of the return lever shaft 55, the return lever 27 swings clockwise as shown in another two dots and dash line in FIG. 5. This swinging movement returns a sheet of copying paper 90 remaining pinched between the forward rotation roller 25 and backward rotation roller 26, onto the lifting plate 32 disposed rearwardly.

When plural sheets of copying paper 91 are subsequently manually inserted into the manual feed opening 105, the sheets of copying paper 91 are guided by the manual feed guide 72 to the position under the feed roller 24 and the leading end of the sheets stops upon contact with the tray 31 of the cassette 21. The leading end of the manually fed copying paper 91 may be guided into contact with a guide plate 106 extending from the cassette receiving socket 101 or with the return lever 27 at the position shown in the two dots and dash line. The leading end of copying paper 91 may be guided into contact with a specially provided leading end limiting member connected to the manual feed opening cover 71.

Figure 6:
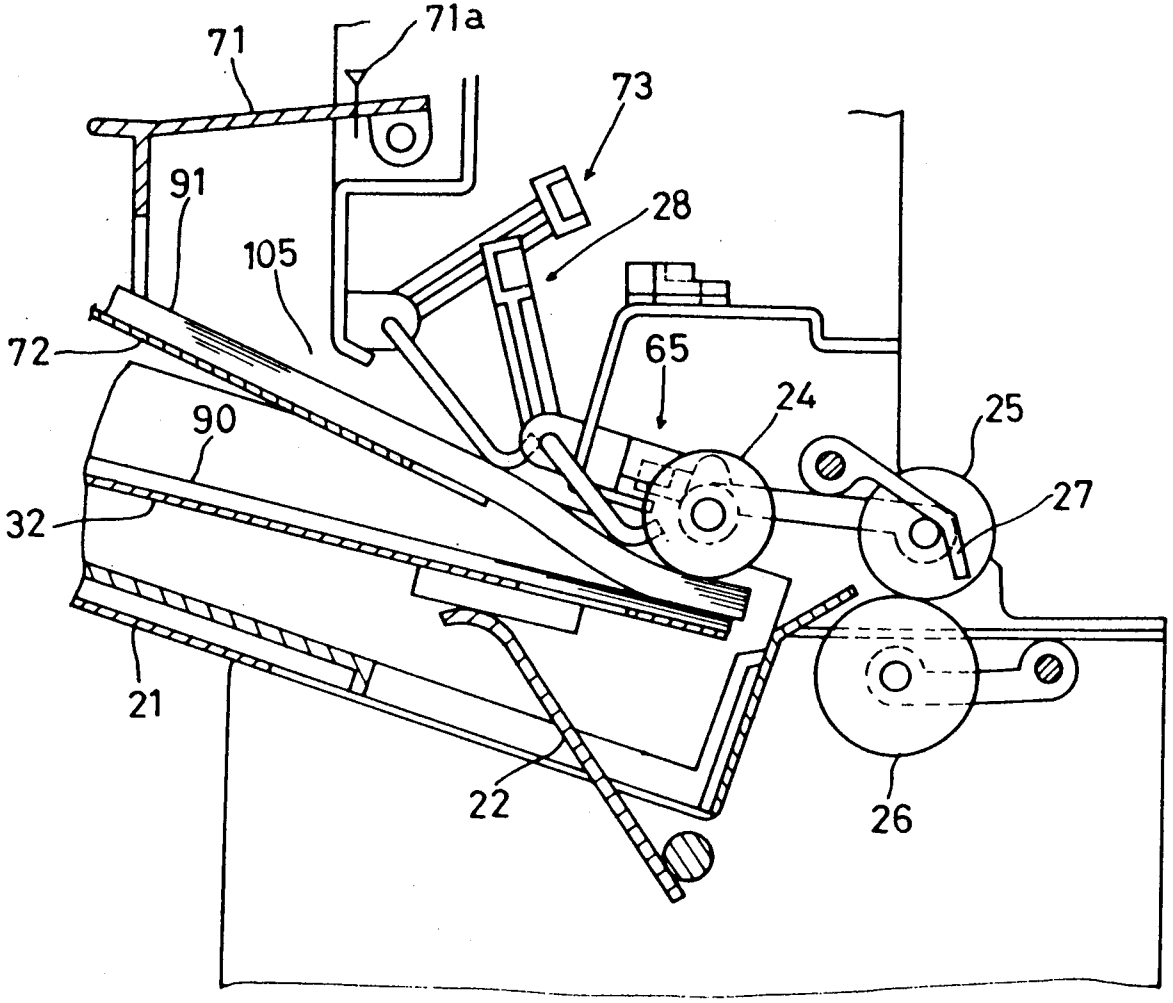
FIG. 6 is a sectional view of the paper feeding section with the cover for the manual feed opening closed.

The manually fed copying paper 91, as it advances, pushes up the detecting levers 80 and 62 of the manually fed paper detecting switch 73 and copying paper detecting switch 28, respectively, which results in the detection of manually fed copying paper 91. When the manual feed opening cover 71 is returned to the closed position, the cover detecting switch **71*a* is turned on, and an unillustrated detecting switch is turned on to actuate the motor 40 immediately, whereby the lift lever 22 pushes the copying paper 90 upward. As shown in FIG. 6, the lift lever 22 pushes up the leading end of the manually fed copying paper 91 bringing the copying paper 90 into pressure contact with the feed roller 24, and further pushes up the feed roller 24. The lift detecting switch 65 is then turned on to stop the motor 40, and the manually fed copying paper 91** becomes ready for use.

When the print switch is pressed in this state, the manually fed copying paper 91 is advanced as in the case of copying paper 90 contained in the cassette 21, and a designated number of copies are made. The feed roller 24 lowers with a decrease in the number of sheets of manually fed copying paper 91. The lift detecting switch 65 detects the descent of the feed roller 24, and actuates the lifting mechanism 23 as described. Consequently, the manually fed copying paper 91 contacts the feed roller 24 under a constant pressure all the time. The manual feed copying mode is maintained while the manually fed copying paper 91 remains in position, and copies are taken on the copying paper 91 by pressing the print switch. A changeover cannot occur from the manual paper feeding device 70 to the paper feeding section **21*a* which shares the feed roller 24 with the manual paper feeding device 70, but a changeover to the other paper feeding section 21*b*** is allowed.

When the manually fed copying paper 91 is exhausted, the manually fed paper detecting switch 73 operates to give a corresponding indication. The manual feed copying mode is stopped upon lapse of a fixed time therefrom, and it is then possible to feed the copying paper from the feeding section **21*a***. Thus, the cassette paper feed mode takes place after copying with the manually fed copying paper is completed, without the trouble of returning a manual feed table to an original position as in the conventional copying machines.

The manual feed opening cover 71 may be opened after a selected number of copies are made with the manually fed copying paper. Then, as already described, the cam 76 causes the mounting plate 39 to pivot and lower the lift lever 22. Simultaneously, the backward rotation roller 26 moves away from the forward rotation roller 25 and the return lever 27 returns a sheet of manually fed copying paper 91 which had advanced into the copying machine. Thus, remaining sheets of copying paper 91 may readily be withdrawn.

As shown in FIG. 5, any number of sheets of the copying paper 91 may be placed in position within a limit determined by the size of manual feed opening 105 and by the size of spacing between the feed roller 24 and the lowered copying paper 90.

A single sheet of copying paper may be manually inserted by using the manual paper feeding device 70 in exactly the same way as a plurality of sheets are manually inserted. Thus, a single sheet is handled by a similar operation and its description is omitted.

In the described example, the interlocked operation of the manual feed opening cover 71 and the lift lever 22 is effected through the cam 76 associated with the cover 71 to disengage the second reduction gear 43 from the segment gear 35 which causes the pivotal movement of the lift lever 22. However, the interlocking mechanism is not limited to this construction but may comprise a lever link mechanism or other mechanical means, or may comprise electrical means such as a solenoid and a motor.

Further, the lift lever 22 is pushed upward by the motor 40 in the described embodiment but the lift lever 22 may be pushed by a spring or other means.

E. Control Panel 110

Figure 7:
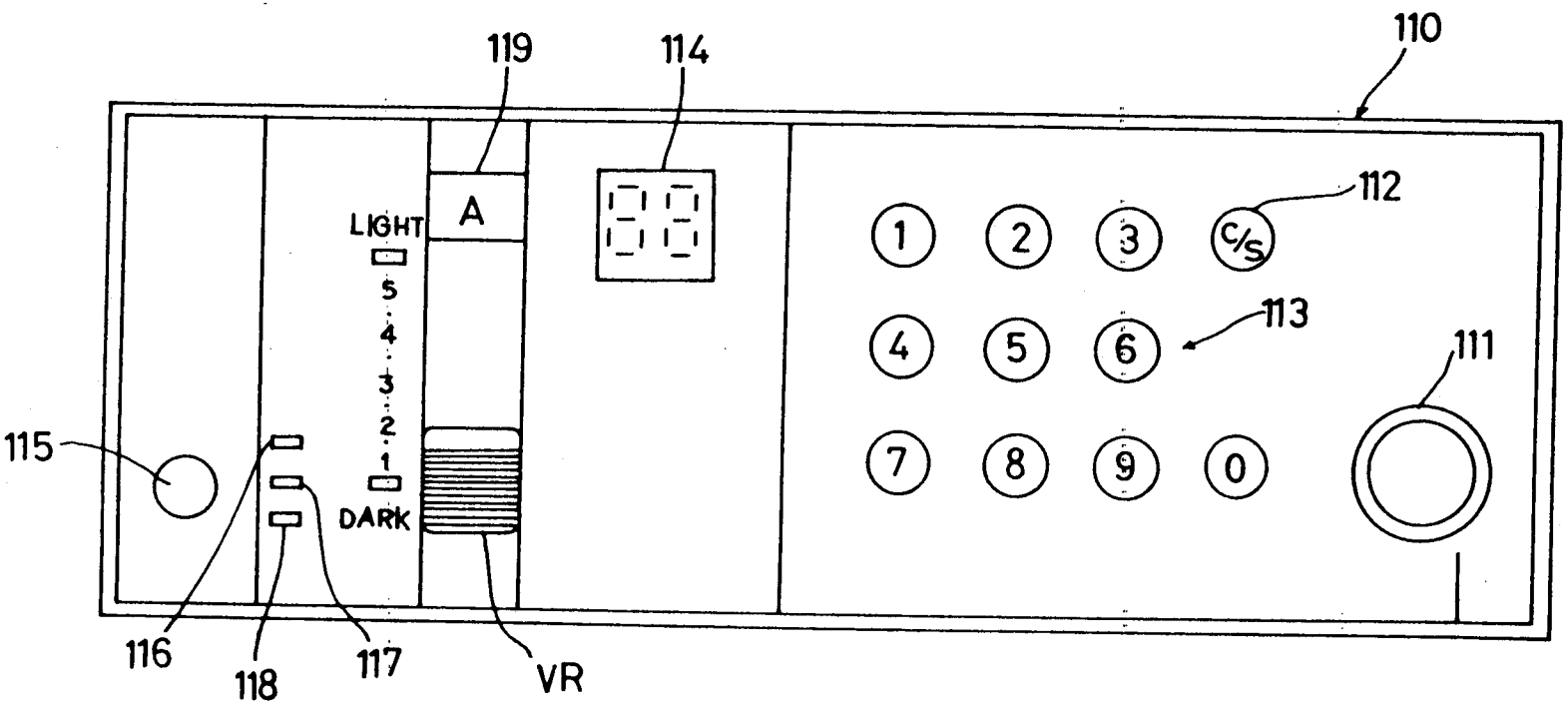
FIG. 7 is a plan view of a control panel.

The copying machine has a control panel 110 as shown in FIG. 7, provided on top of the machine body 100. The control panel 110 includes a print switch 111 for starting a copying operation, a clear/stop key 112 for cancelling the copying operation immediately after starting it or stopping a multicopying operation halfway and clearing a number shown on a number of copies indicator 114 comprising light emitting diodes, ten keys 113 for setting the numbers "0" to "9", a variable resistor VR for manually increasing or decreasing the quantity of light emitted by the exposure lamp of the optical system 3, an automatic exposure mode select switch 119 for automatically providing optimal exposure for an original document, a paper feed select switch 115, and light emitting diodes 116–118. The paper feed select switch 115 is used for selecting one of the upper cassette paper feed mode in which the copying paper is fed from the cassette 21 (hereinafter referred to as an upper cassette 21*a*) in the paper feeding section 20*a*, the lower cassette paper feed mode in which the copying paper is fed from the cassette 21 (hereinfafter referred to as a lower cassette 21*b*) in the paper feeding section 20*b*, or the manual paper feed mode in which the copying paper is fed from the manual paper feeding device 70. The light emitting diodes 116–118 are switchable in a rotating mode by pressing the paper feed select switch 115 which indicates selection of the three paper feed modes noted above, respectively.

F. Control Circuit F

Figure 8:
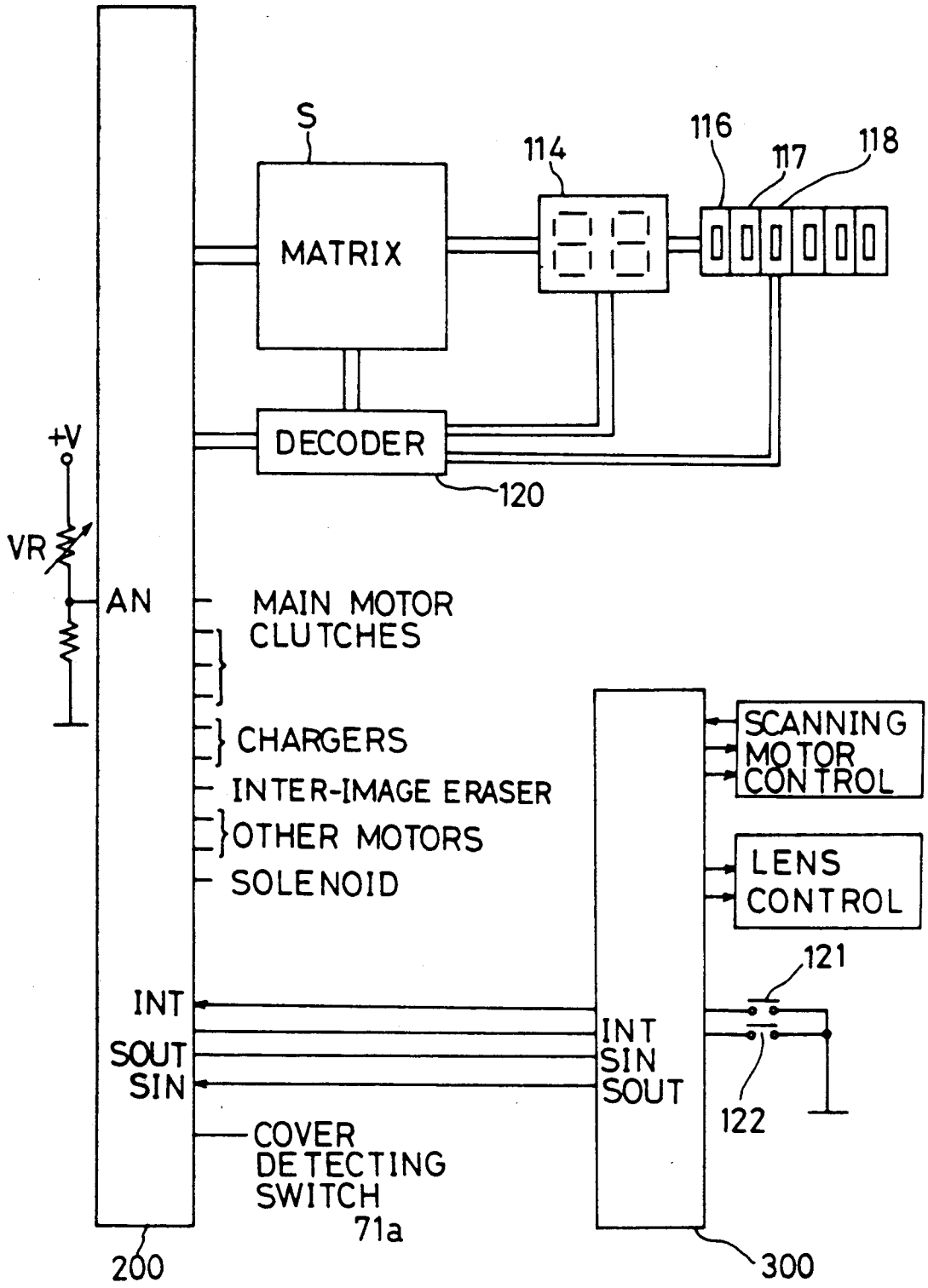
FIG. 8 is a block diagram of a control circuit.

The copying machine has a control circuit as shown in FIG. 8. The control circuit includes a first CPU 200 and a second CPU 300 each comprising a microprocessor. The first CPU 200 is connected to a matrix which has various switches and keys arranged lengthwise and crosswise, and to the cover detecting switch 71*a*. In response to operations of the switches, keys and various sensors, the first CPU 200 controls a main motor of the copying machine, various roller clutches and the like. The first CPU 200 also turns the various light emitting diodes such as the number of copies indicator 114 on and off by the decoder 120.

The second CPU 300 is connected to a scanning motor control, a magnifying lens control, a detecting switch 121, and a timing switch 122 which mainly controls the optical system 3 and document scanning. The first and second CPUs 200 and 300 are interconnected to be operable in synchronism.

G. Control Operations

The control operations of the above control circuit will be described in connection with the paper feeding device.

(a) Main Routine

Figure 9:
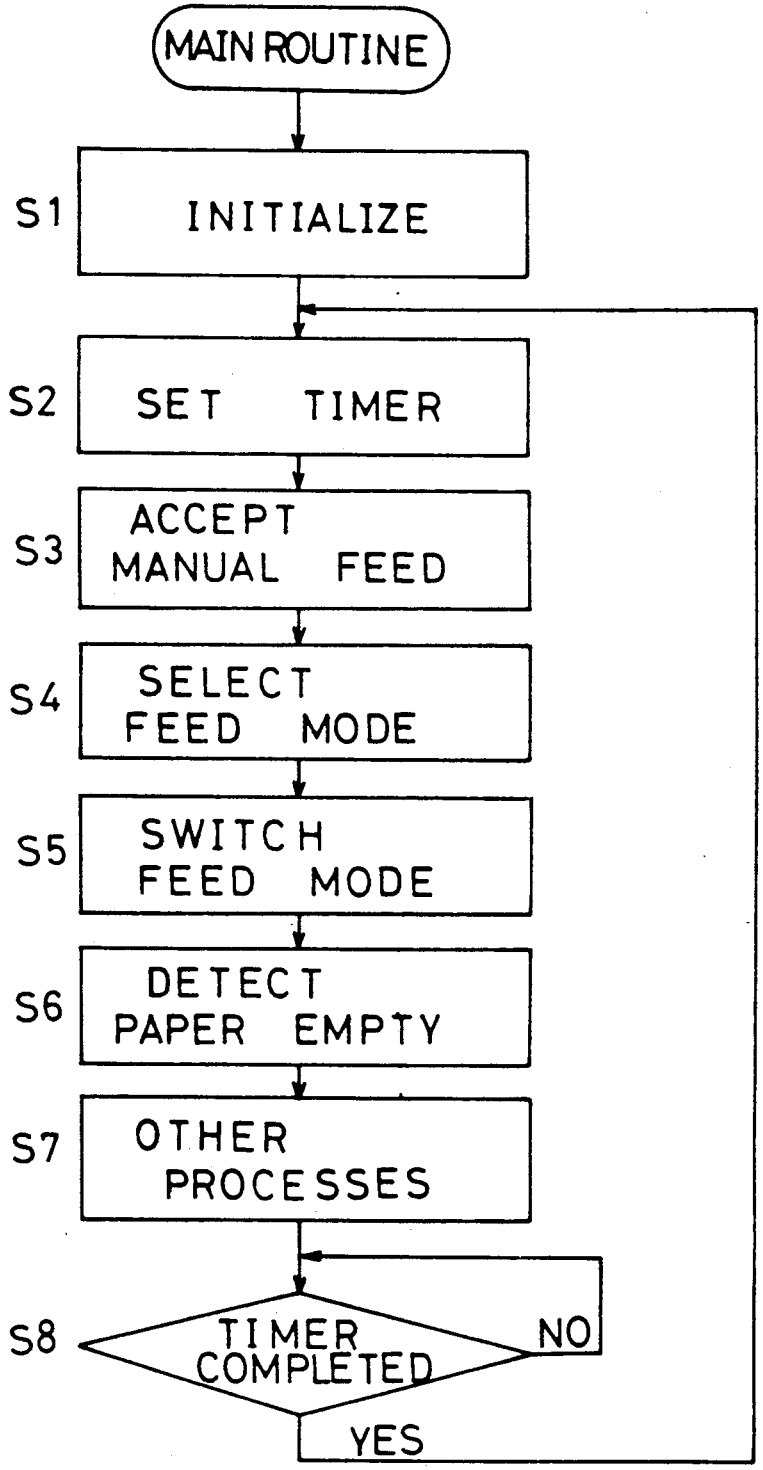
FIG. 9 is a flow chart of a main routine.

FIG. 9 shows a main routine for controlling the overall operation of the copying machine. When the program is started, step S1 initializes the first and second CPUs 200 and 300, which clears the RAMs and sets the various registers, and sets other devices to the initial mode. In step 2, an internal timer is set and then is started. Thereafter the program executes various subroutines including a manual copying paper feed accepting subroutine executed at step S3, a paper feed mode selecting subroutine executed at step S4, an automatic paper feed mode switching subroutine executed at step S5, a paper empty detecting subroutine executed at step S6, and other processes executed at step S7. One routine is completed when the internal timer stops at step S8, and the program returns to step S2. The length of the period for one routine is used for operating various timers appearing in the subroutines. That is, the number of times this routine is repeated provides the basis for judging completion of the various timers.

(b) Manual Paper Feed Accepting Subroutine

Figure 10A:
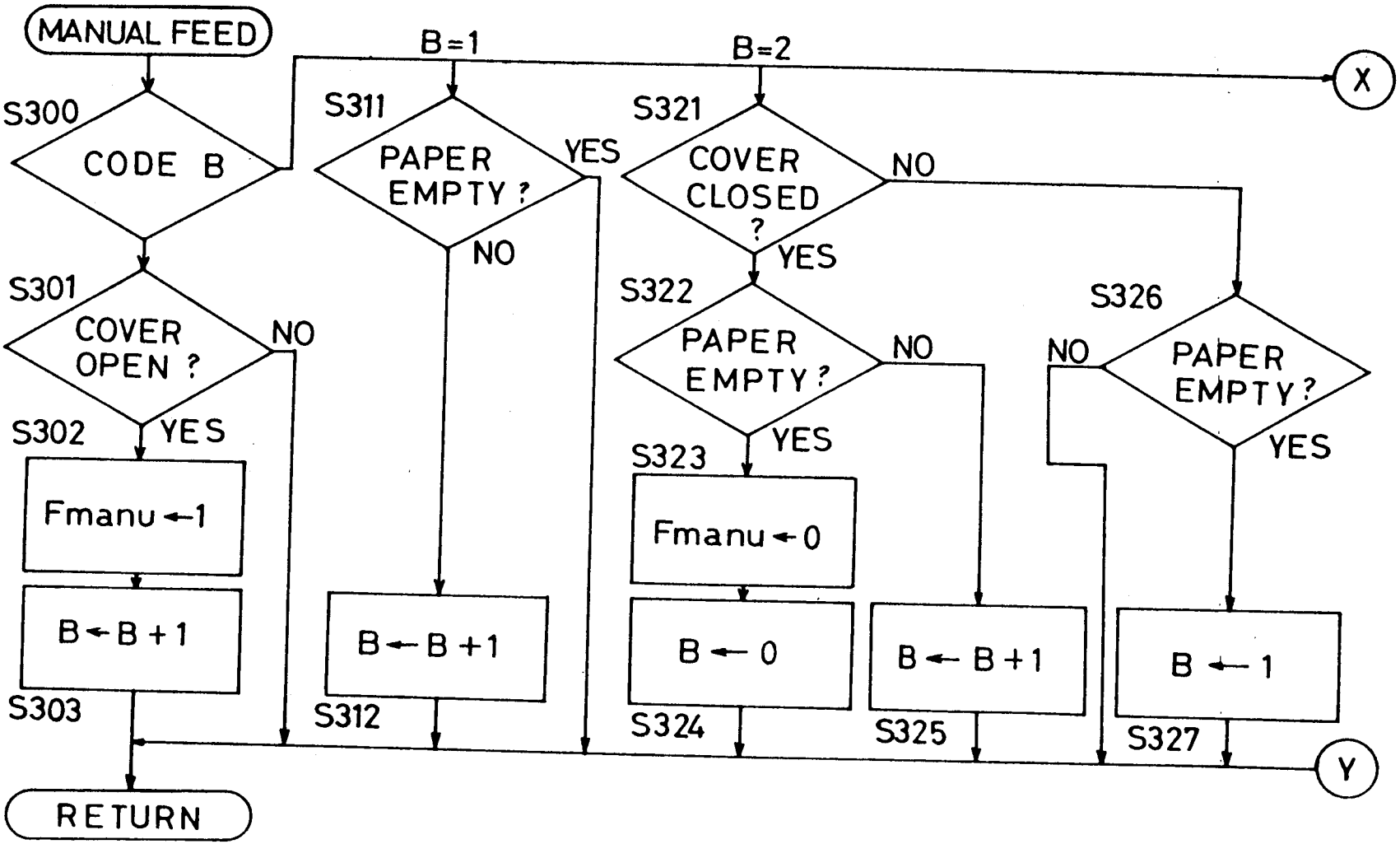
FIGS. 10*a* and 10*b* are a flow chart of a manual paper feeding subroutine.
Figure 10B:
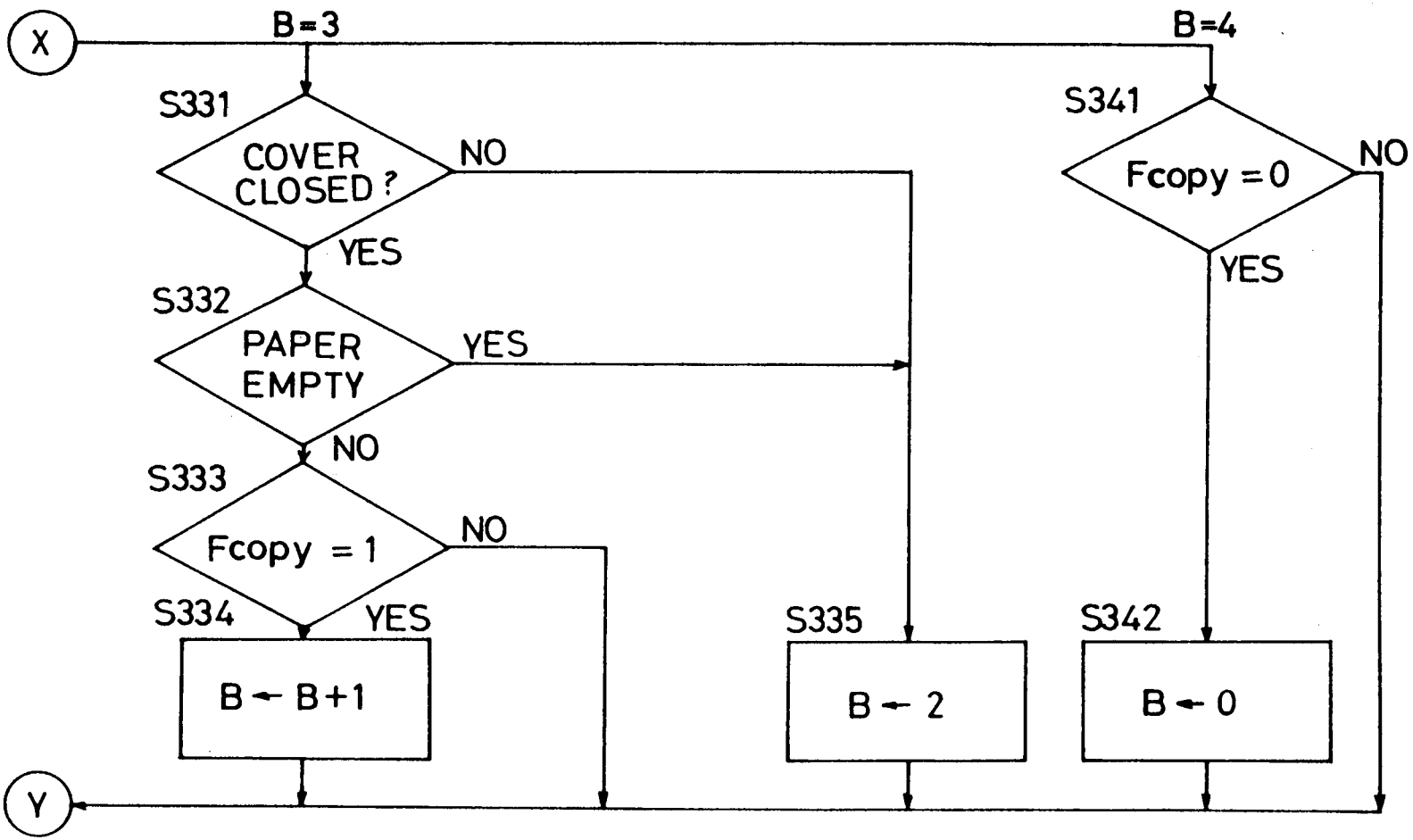

FIGS. 10*a* and 10*b* show the manual paper feed accepting subroutine. First, step S300 judges the value of code B. The code B is set to "0" at the initializing step S1 of the main routine when the power is switched on for the copying machine.

When code B is "0", the program moves to step S301 to determine from the signal provided by the cover detecting switch 71*a* whether the manual feed opening cover 71 is opened or not. If the cover 71 is open, step S302 sets a manual feed flag Fmanu to "1" and step S303 adds "1" to code B. If the cover 71 is closed, the program returns to the main routine without changing the value of code B.

When code B is "1", step S311 determines from the manually fed copying paper detecting switch 73 whether the copying paper 91 has been manually placed on the manual feed guide 72 or not. If there is copying paper 91, step S312 adds "1" to code B. If there is no copying paper 91 on the guide 72, then the program just returns to the main routine.

In other words, the program moves on to succeeding steps if the cover 71 is opened and the copying paper 91 is manually set in position. A standby occurs if the cover 71 is opened but the copying paper 91 is not set in position.

When code B is "2", steps S321 and S322 determine from signals provided by the switches 71*a* and 73 whether the cover 71 is closed and the copying paper 91 is exhausted. Affirmative results will mean that all the sheets of copying paper 91 manually fed through the opening 105 have been used up. Consequently, step S323 sets the manual feed flag Fmanu to "0" and then step S324 sets code B to "0". If the cover 71 is closed and the copying paper 91 is set in position, step S325 adds "1" to code B (i.e. sets code B to "3"). If the cover 71 is open, step S326 judges whether there is copying paper 91 or not. If there is copying paper 91, then the program takes a standby. If there is no copying paper 91, code B is set to "1".

When code B is "3", steps S331 and S332 determine whether the cover 71 is closed and the copying paper 91 is set in position. If in the affirmative, then step S333 determines whether a copy is being taken or not. If it is, "1" is then added to code B. If not, the program makes a return. If either the cover 71 is open or there is not copying paper 91, step S335 sets code B to "2".

When code B is "4", which indicates that a copy is being made in the manual paper feed mode, the program moves to step S341 for determining whether the copying operation is completed or not. When it is completed, step S342 sets code B to "0". If not, the program standsby until the copying operation is completed.

As described above, the manual paper feed flag Fmanu is set to "1" when the cover 71 is open and when the cover 71 is closed and the copying paper 91 is set in position. The flag Fmanu is set to "0" only when the cover 71 is closed and the copying paper 91 is not set in position.

(c) Paper Feed Mode Selecting Subroutine

Figure 11:
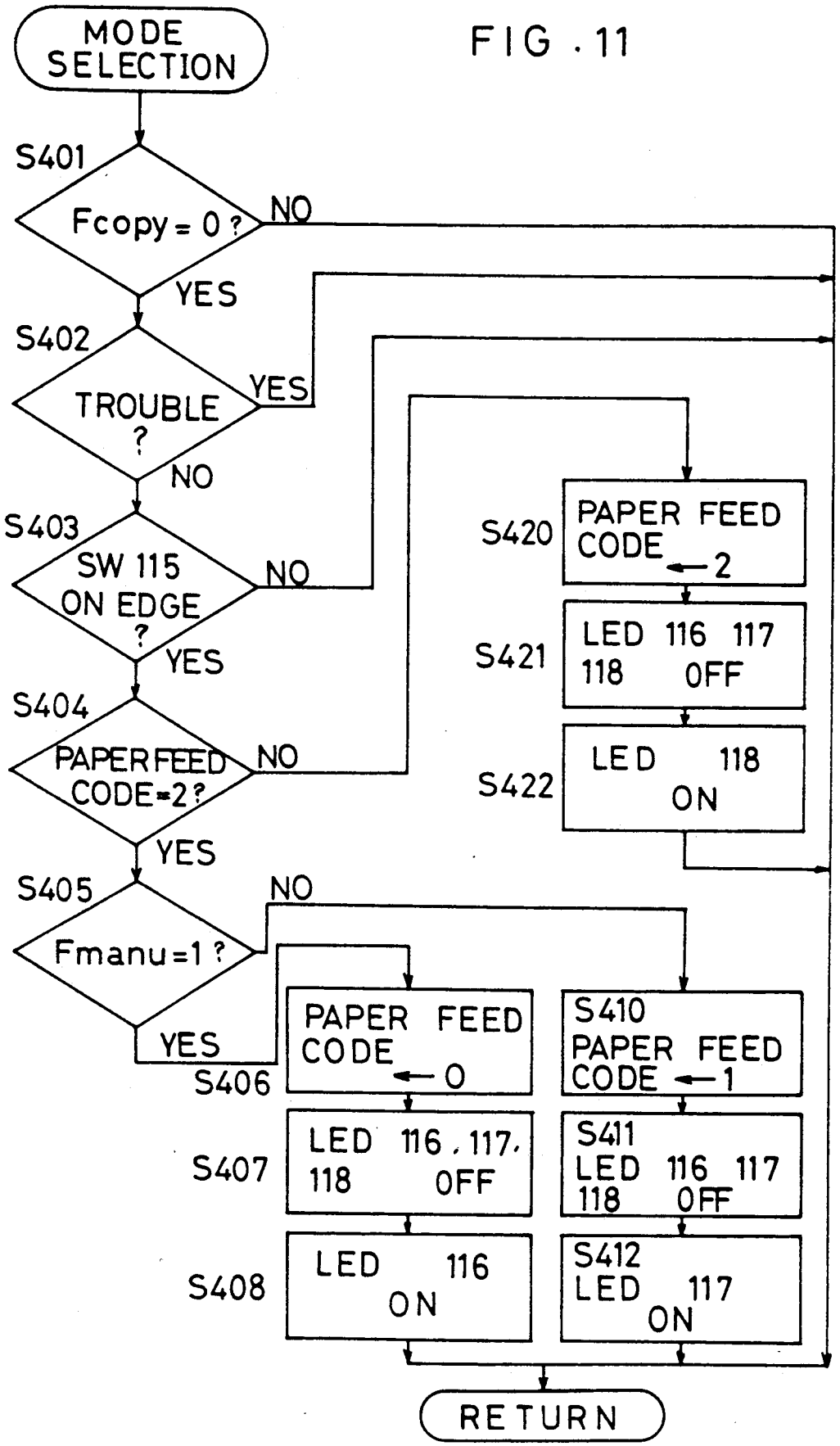
FIG. 11 is a flow chart of a paper feed mode selecting subroutine.

FIG. 11 shows the paper feed mode selecting subroutine which is executed for switching the paper feed modes in response to the operation of paper feed select switch 115 on the control panel 110 and selectively lighting the light emitting diodes 116–118 in accordance with the selected mode. Paper feed code "1" indicates that the upper cassette paper feed mode for feeding copying paper 90 from the upper cassette 21*a* has been selected. Paper feed code "2" indicates that the lower cassette paper feed mode for feeding copying paper 90 from the lower cassette 21*b* has been selected. Paper feed code "0" indicates that the manual paper feed mode for feeding copying paper 91 by the manual paper feeding device 70 has been selected. The paper feed code is set to "1" at the initializing step S1 of the main routine when the power is turned on for the copying machine.

If a copying operation is not carried out in steps S401 through S403 without any trouble and an on-edge state of the paper feed select switch 115 is detected, the program moves to step S404 to determine whether the paper feed code is "2" which indicates the previous selection at the time of pressing the select switch 115. That is, a determination is made whether the lower cassette paper feed mode has been selected before the select switch 115 is pressed.

If the lower cassette paper feed mode was selected, then the program moves to step S405. If the upper cassette paper feed mode or the manual feed mode has been selected, then the program moves to step S420.

Step S405 determines whether the manual feed flag Fmanu is "1" or not. If it is, i.e. the manual feed opening cover 71 is open or copying paper 91 has been manually set on the paper guide 72, the program moves to step S406 which sets the paper feed code to "0" (manual paper feed mode). Then, step S407 turns off the light emitting diodes 116–118 on the control panel 110 once, and step S408 turns on only the diode 116 to indicate on the control panel 110 that the manual paper feed mode has been selected.

If the flag Fmanu is "0", i.e. the cover 71 is closed and copying paper 91 is not set on the paper guide 72, step S410 sets the paper feed code to "1" (upper cassette paper feed mode). Then, step S411 turns off the light emitting diodes 116–118 once, and step S412 turns on only the diode 117 to indicate that the upper cassette paper feed mode has been selected.

Step S420 sets the paper feed code to "2" (lower cassette paper feed mode), step S421 turns off the light emitting diodes 116–118 once, and step S422 turns on only the diode 118 to indicate that the lower cassette paper feed mode has been selected.

Thus, when the paper feed select switch 115 is pressed during the lower cassette paper feed mode, the mode is switched to the manual paper feed mode or the upper cassette paper feed mode. The manual feed mode is selected at this time if either the cover 71 is open or the copying paper 91 has been manually set in position. The mode is switched to the upper cassette paper feed mode only when the cover is open but there is no copying paper 91. When the select switch 115 is pressed during the upper cassette paper feed mode or the manual paper feed mode, the switching is always made to the lower cassette paper feed mode without maintaining or switching to the upper cassette paper feed mode.

(d) Automatic Paper Feed Mode Switching Subroutine

Figure 12A:
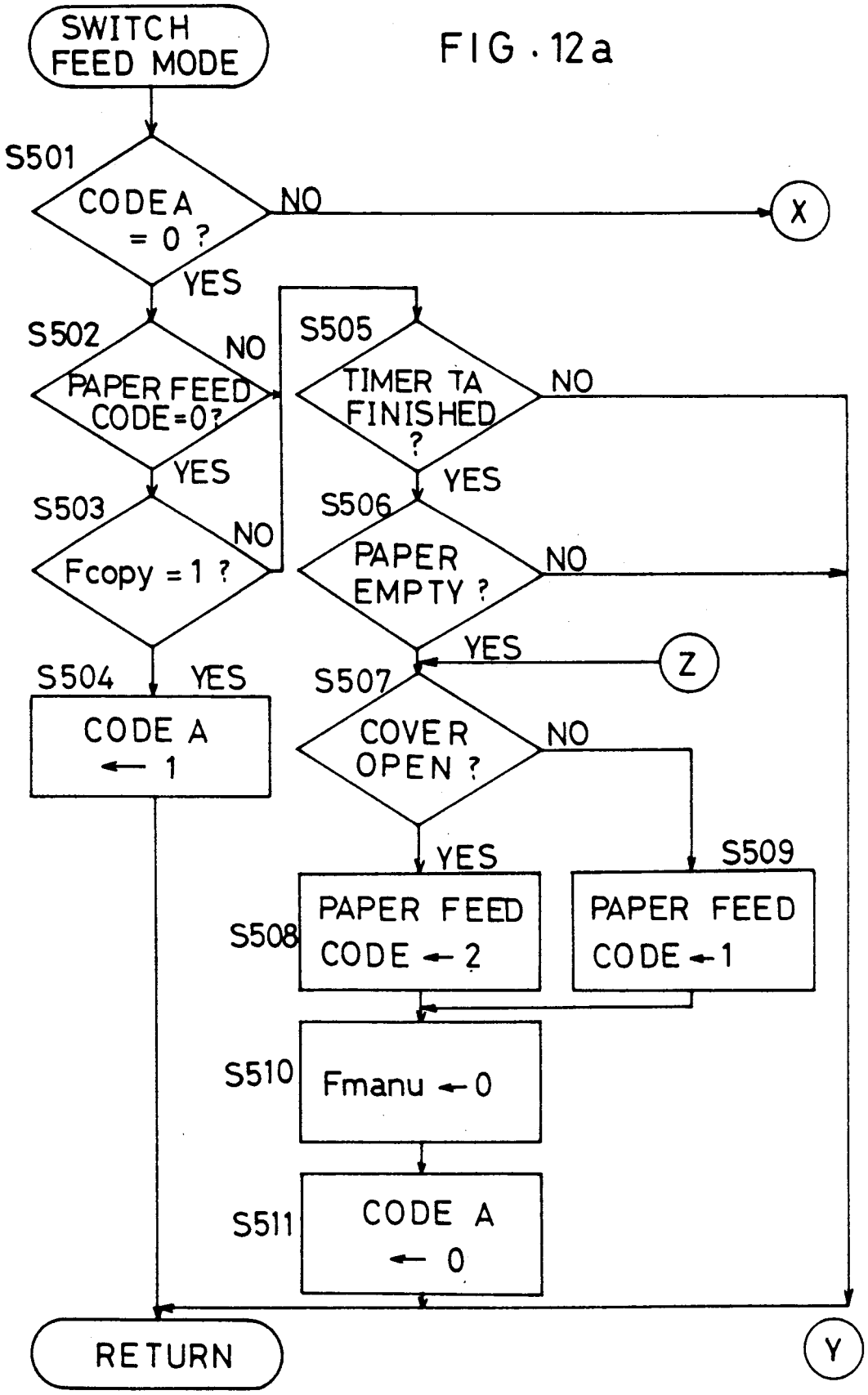
FIGS. 12*a* and 12*b* are a flow chart of an automatic paper feed mode switching subroutine.
Figure 12B:
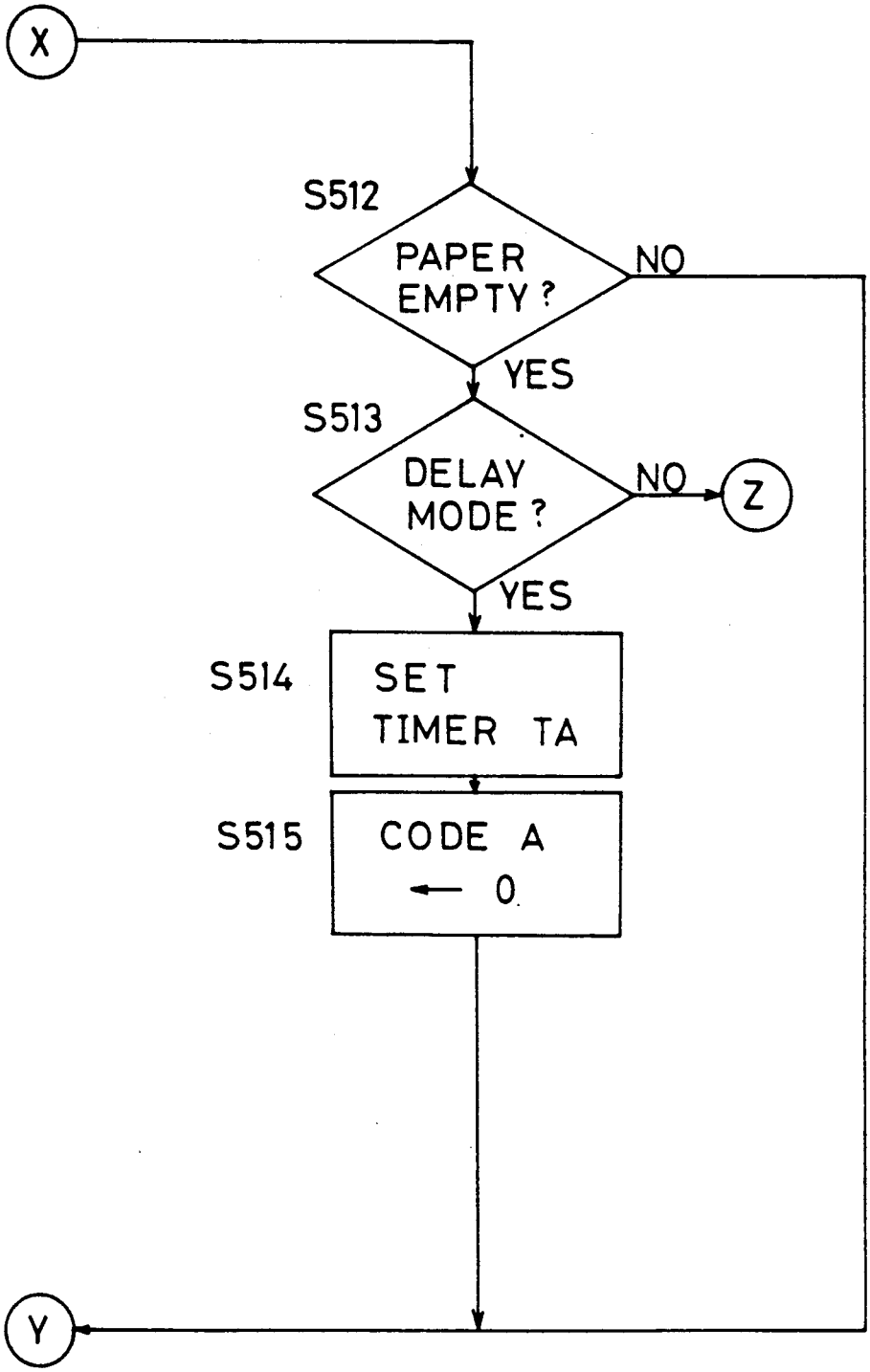

FIGS. 12*a* and 12B show the automatic paper feed mode switching subroutine which is executed for switching from the manual paper feed mode to the cassette paper feed modes when the copying paper 91 on the paper guide 72 is used up.

First, step S501 checks code A. Code A is set to "1" at the initializing step S1 of the main routine when the power is turned on for the copying machine.

When code A is "1" and not "0", the program moves to step S512 to determine whether there is manually fed copying paper 91 on the paper guide 72 or not. If there is, the program standsby. If there is no copying paper 91, the program moves to step S513 to determine whether the prevailing mode is for switching to the cassette paper feed modes immediately following the paper empty detection or with a predetermined delay. In the latter case, i.e. a delay mode, step S514 sets a delay timer TA and step S515 sets code A to "0". Otherwise the program jumps to step S507 to be described later.

The delay mode is set by a mode select switch, not shown, which is provided in the copying machine for a serviceman to operate.

When code A is "0", steps S502 and S503 judge whether the paper feed code is "0" (manual paper feed mode) and a copy is being made. If the results are in the affirmative, step S504 sets code A to "1". If the machine is operating in a mode other than the manual paper feed mode or a copy is not being made, step S505 determines whether the delay timer TA has finished counting and step S506 determines whether the copying paper 91 has been exhausted. If the copying paper 91 is judged to be exhausted after the timer TA has finished counting, step S507 determines whether the manual feed opening cover 71 is open or not. If it is, step S508 sets the paper feed code to "2" (lower cassette paper feed mode). If the cover 71 is closed, step S509 sets the paper feed code to "1" (upper cassette paper feed mode).

Thus, switching is automatically made to the lower cassette paper feed mode with the predetermined delay set by the timer TA if there is no copying paper 91, even if the cover 71 is open.

Subsequently, step S510 sets the manual feed flag Fmanu to "0", and step S511 sets code A to "0".

(e) Paper Empty Detecting Subroutine

Figure 13:
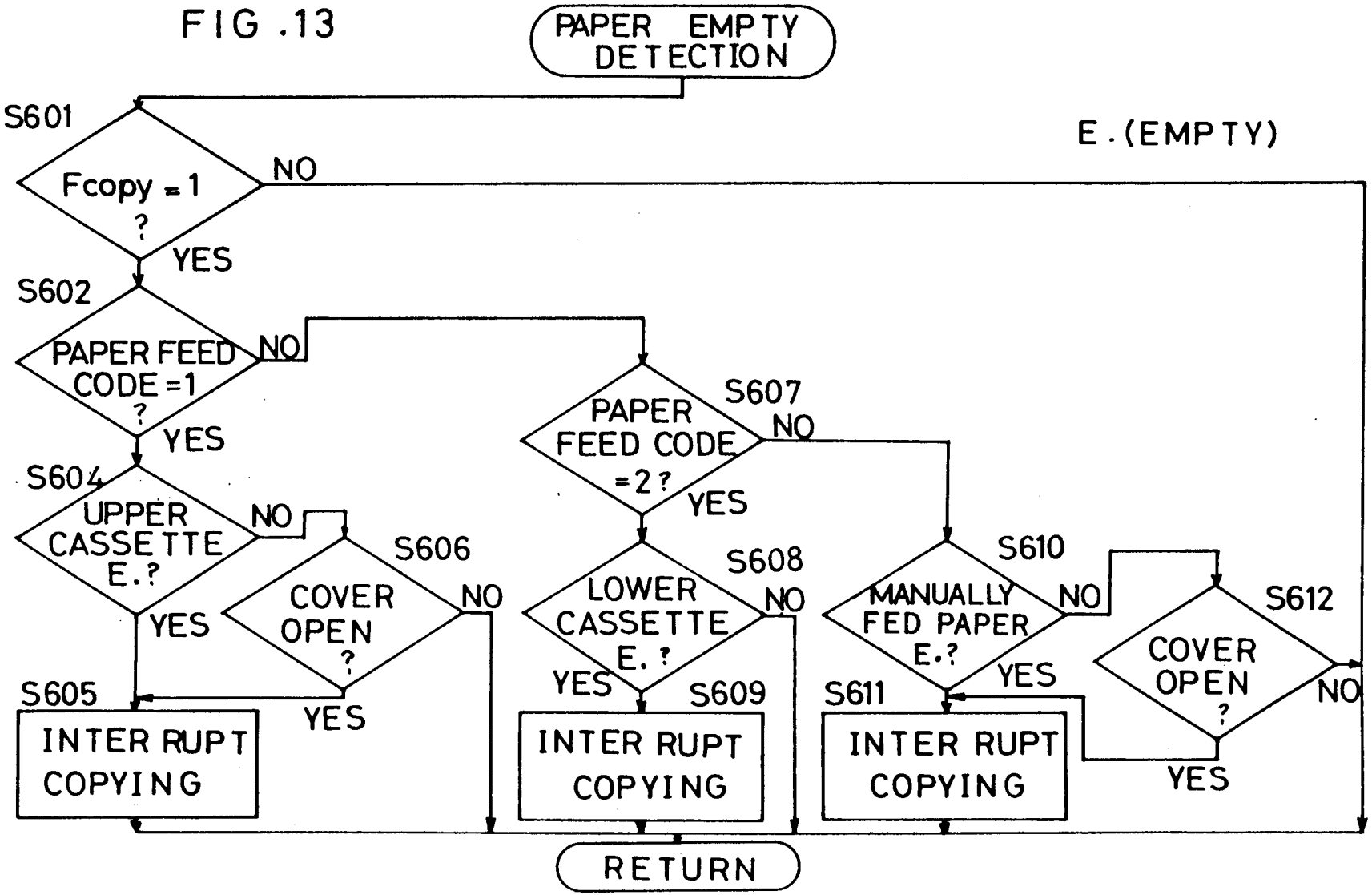
FIG. 13 is a flow chart of a paper empty detecting subroutine.

FIG. 13 shows the paper empty detecting subroutine which is executed for interrupting a copying operation when the cassette is empty of copying paper 90, when the manual feed opening cover 71 is opened during one of the cassette paper feed modes, or when the cover 71 is opened or copying paper 91 is used up during the manual paper feed mode.

First, step S601 determines whether a copy is being made. If it is, step S602 judges whether the paper feed code is "1" (upper cassette paper feed mode). If the paper feed code is "1", the program moves to step S604. If the paper feed code is "0" (manual paper feed mode) or "2" (lower cassette paper feed mode), the program moves to step S607.

Step S604 determines whether the upper cassette 21*a* is empty of copying paper 90. If it is, step S605 interrupts the copying operation. If not, step S606 determines whether the cover 71 is opened. If the cover 71 is opened, the copying operation is interrupted.

Step S607 determines whether the paper feed code is "2" (lower cassette paper feed mode). If it is, step S608 determines whether the lower cassette 21*b* is empty of copying paper 90. If it is empty, step S609 interrupts the copying operation.

If step S607 finds the paper feed code to be "0" (manual paper feed mode), step S610 determines whether there remains any manually fed copying paper 91. If there is no copying paper 91, the copying operation is interrupted at step S611. If there is the copying paper 91, step S6612 determines whether the cover 71 has been opened. If it has, the copying operation is interrupted.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying machine allowing copying paper to be fed manually, comprising:

an automatic paper feeding section including support means for supporting copying paper to be fed automatically, feed means for feeding the copying paper, and switch means for selectively providing a state in which the copying paper is pressed between said support means and said feed means and a state in which the copying paper is released from a pressing force;

inlet means for receiving copying paper inserted manually and allowing the manually inserted copying paper to advance to a position between said support means and said feed means and to be pressed therebetween by action of said switch means;

means for forming images on the copying paper; and control means for controlling feeding of the copying paper pressed between the support means and the feed means to the image forming means.

2. A copying machine as claimed in claim 1, wherein said feed means includes a feed roller for cooperating with said support means to press the copying paper therebetween in response to said switch means, and delivery roller means for further advancing the copying paper advanced by said feed roller.

3. A copying machine as claimed in claim 1, further comprising a manual feed guide for guiding the copying paper manually inserted through said inlet to said feed means.

4. A copying machine allowing copying paper to be fed manually, comprising:

an inlet for receiving manually inserted copying paper;

cover means for opening and closing said inlet;

an automatic paper feeding section including support means for supporting copying paper to be fed automatically, feed means for feeding the copying paper, and switch means operatively connected to said cover means for selectively providing a state in which the copying paper is pressed between said support means and said feed means and a state in which the copying paper is released from a pressing force, said switch means being operable to press the copying paper between said support means and said feed means when said cover means is closed and to release the copying paper from the pressing force when said cover means is opened;

a manual feed guide for guiding the copying paper manually inserted through said inlet to a position between said support means and said feed means in a non-pressing state; and control means for controlling the copying machine in response to opening and closing of said cover means.

5. A copying machine as claimed in claim 4, wherein said switch means includes a pressing lever for pressing said support means toward said feed means, said pressing lever being operable to impart a pressing force for causing the manually inserted copying paper and/or the automatically fed copying paper to be nipped between said support means and said feed means, removal of the pressing force results in a loose relationship between said support means and said feed means for accepting entry of the manually inserted copying paper.

6. A copying machine as claimed in claim 4, wherein said feed means includes a feed roller for cooperating with said support means to press the copying paper therebetween in response to said switch means, and delivery roller means for further advancing the copying paper advanced by said feed roller.

7. A copying machine as claimed in claim 4, wherein said control means is operable to control the copying machine in a manual paper feed mode in which the copying paper is fed through said inlet and in an automatic paper feed mode in which the copying paper is fed from said automatic paper feeding section, the manual paper feed mode being automatically switched to the automatic paper feed mode when said cover means remains closed for a predetermined period during the manual paper feed mode after the copying paper fed through said inlet is exhausted.

8. A copying machine as claimed in claim 4, further comprising paper feed mode selecting means for switching between a manual paper feed mode and an automatic paper feed mode, wherein said control means is operable to control the copying machine in the manual paper feed mode in which the copying paper is fed through said inlet and in the automatic paper feed mode in which the copying paper is fed from said automatic paper feeding section, and said control means allowing said paper feed mode selecting means to switch from the manual paper feed mode to the automatic paper feed mode when the copying paper fed through said inlet is exhausted and said cover means is closed.

9. A copying machine as claimed in claim 8, further comprising an additional automatic paper feeding section dissociated from said manual feed guide, wherein said control means allows said paper feed mode selecting means to switch from the manual paper feed mode to an automatic paper feed mode in which said additional automatic paper feeding section is used when the copying paper fed through said inlet is remained in position.

10. A copying machine as claimed in claim 4, wherein said control means is operable to allow a copying operation with the manually inserted copying paper only when said cover means is closed and to interrupt the copying operation when said cover means is opened during a manual paper feed mode.

11. A copying machine as claimed in claim 10, further comprising a start means for applying a copying operation trigger signal to said control means, wherein said control means rejects the trigger signal from said start button when said cover means is opened during the manual paper feed mode.

12. A copying machine allowing copying paper to be fed manually, comprising:

an inlet for receiving manually inserted copying paper;

cover means for opening and closing said inlet;

cover position detecting means for detecting opening and closing of said cover means;

manually fed paper detecting means for detecting presence and absence of the copying paper manually inserted through said inlet;

an automatic paper feeding section having copying paper to be fed automatically; and control means for controlling the copying machine in a manual paper feed mode in which the copying paper is fed through said inlet and in an automatic paper feed mode in which the copying paper is fed from said automatic paper feeding section, said control means being operable to switch from the manual paper feed mode to the automatic paper feed mode when said cover position detecting means detects said cover means remaining closed for a predetermined period during the manual paper feed mode after said manually fed paper detecting means detects absence of the copying paper inserted manually.

13. A copying machine allowing copying paper to be fed manually, comprising:

an inlet for receiving manually inserted copying paper;

cover means for opening and closing said inlet;

cover position detecting means for detecting whether said cover means is opened or closed;

manually fed paper detecting means for detecting presence and absence of the manually inserted copying paper in said inlet;

an automatic paper feeding section including support means for supporting copying paper to be fed automatically;

feed means for feeding the automatically fed copying paper and the manually inserted copying paper, and;

switch means operatively connected to said cover means for selectively providing a state in which the copying paper is pressed between said support means and said feed means and a state in which the copying paper is released from the pressing force, said switch means being operable to press the copying paper between said support means and said feed means when said cover means is closed and to release the copying paper from the pressing force when said cover means is opened;

a manual feed guide for guiding the copying paper manually inserted through said inlet to a position between said support means and said feed means in a nonpressing state;

control means for controlling the copying machine in a manual paper feed mode in which the copying paper is fed through said inlet and in an automatic paper feed mode in which the copying paper is fed from said automatic paper feeding section; and paper feed mode selecting means for switching between the manual paper feed mode and the automatic paper feed mode;

wherein said control means switches said paper feed mode selecting means from the manual paper feed mode to the automatic paper feed mode when said manually fed paper detecting means detects absence of the copying paper inserted manually and said cover position detecting means detects said cover means being closed during the manual paper feed mode.

14. A copying machine as claimed in claim 13, further comprising an additional automatic paper feeding section dissociated from said manual feed guide, wherein said control means allows said paper feed mode selecting means to switch from the manual paper feed mode to an automatic paper feed mode in which said additional automatic paper feeding section is used when said manually fed paper detecting means detects presence of the manually fed copying paper.

15. A copying machine allowing copying paper to be fed manually, comprising:

an inlet for receiving manually inserted copying paper;

cover means for opening and closing said inlet;

an automatic paper feeding section including storing means for storing copying paper to be fed automatically;

feed means for feeding the automatically fed copying paper and the manually inserted copying paper; and control means for controlling the copying machine in a manual paper feed mode in which the copying paper is fed through said inlet and in an automatic paper feed mode in which the copying paper is fed from said automatic paper feeding section, said control means is operable to allow a copying operation with the manually inserted copying paper only when said cover means is closed and to interrupt the copying operation when said cover means is opened during the manual paper feed mode.

16. A copying machine as claimed in claim 15, further comprising a start means for applying a copying operation trigger signal to said control means, wherein said control means rejects the trigger signal from said start means when said cover means is opened during the manual paper feed mode.

* * * * *